US009388779B2

(12) United States Patent
Kim

(10) Patent No.: US 9,388,779 B2
(45) Date of Patent: Jul. 12, 2016

(54) FUEL SYSTEM FOR AN EXCAVATOR

(75) Inventor: Sang-Deuk Kim, Changwon-si (KR)

(73) Assignee: VOLVO CONSTRUCTION EQUIPMENT AB (SE)

( * ) Notice: Subject to any disclaimer, the term of this patent is extended or adjusted under 35 U.S.C. 154(b) by 89 days.

(21) Appl. No.: 14/131,553

(22) PCT Filed: Jul. 13, 2011

(86) PCT No.: PCT/KR2011/005142

§ 371 (c)(1),
(2), (4) Date: Jan. 8, 2014

(87) PCT Pub. No.: WO2013/008968

PCT Pub. Date: Jan. 17, 2013

(65) Prior Publication Data

US 2014/0165968 A1 Jun. 19, 2014

(51) Int. Cl.
*F02M 55/02* (2006.01)
*F02M 37/00* (2006.01)
(Continued)

(52) U.S. Cl.
CPC ..... *F02M 37/0052* (2013.01); *E02F 9/2066* (2013.01); *F02D 33/006* (2013.01);
(Continued)

(58) Field of Classification Search
CPC ... F02M 69/465; F02M 55/02; F02M 55/025; F02M 55/055; F02M 35/10216
USPC ..... 123/468
See application file for complete search history.

(56) References Cited

U.S. PATENT DOCUMENTS 4,288,086 A * 9/1981 Oban et al. ..... 280/834
6,328,883 B1 12/2001 Jensen
(Continued)

FOREIGN PATENT DOCUMENTS

DE 10208425 A1 10/2002
EP 2239450 A1 10/2010
(Continued)

OTHER PUBLICATIONS

International Search Report (in Korean and English) and Written Opinion (in Korean) for PCT/KR2011/005142, mailed Jan. 2, 2012; ISA/KR.
(Continued)

*Primary Examiner* — Lindsay Low
*Assistant Examiner* — Charles Brauch
(74) *Attorney, Agent, or Firm* — Harness, Dickey & Pierce, P.L.C.

(57) ABSTRACT

A fuel system is disclosed which is adapted to improve engine ignition properties by ensuring that, when the engine ignition is turned off, residual fuel left over in the engine area after use is not returned to the fuel tank but instead remains in a common rail injector area. The fuel system for an excavator according to the present invention comprises: a fuel tank having a fuel supply line for discharging fuel and a return line for returning residual fuel after combustion in the engine area; a water-fraction separator which is provided downstream of the fuel tank, removes the water fraction contained in the fuel that is sucked in, and consists of a hand pump that is linked to the fuel supply line and of a first filter that is linked to the hand pump and filters out extraneous material in the fuel; an injection pump which is provided downstream of the water-fraction separator and which provides an injector with a high pressure supply of the fuel, from which the extraneous material has been filtered out on passing through the first filter and a second filter linked thereto, such that said fuel is sprayed into an engine combustion chamber; a fuel control unit which is respectively linked to the second filter and the injection pump and controls the injection pump so as to control the volume of fuel supplied to the injector; and a check valve which is provided in the return line and ensures that, when the equipment is made to stop working because the engine ignition is turned off, residual fuel left over in the engine area after use is not returned to the fuel tank along the return line but instead remains in the injector area.

1 Claim, 1 Drawing Sheet

(51) Int. Cl.

| | |
|---|---|
| ***E02F 9/20*** | (2006.01) |
| ***F02M 37/16*** | (2006.01) |
| ***F02M 37/22*** | (2006.01) |
| ***F02D 33/00*** | (2006.01) |
| *F02M 69/46* | (2006.01) |
| *F02M 55/00* | (2006.01) |
| *F02M 35/10* | (2006.01) |
| *F02M 63/02* | (2006.01) |

(52) U.S. Cl.

CPC ..... *F02M37/0029* (2013.01); *F02M 37/16* (2013.01); *F02M 37/221* (2013.01); *F02D 2200/0602* (2013.01); *F02M 35/10216* (2013.01); *F02M 55/005* (2013.01); *F02M 55/02* (2013.01); *F02M 55/025* (2013.01); *F02M 63/0225* (2013.01); *F02M 69/465* (2013.01); *F02M 2037/225* (2013.01); *F02M 2200/60* (2013.01)

(56) References Cited

U.S. PATENT DOCUMENTS

| | | | | |
|---|---|---|---|---|
| 7,350,510 | B2 | 4/2008 | Tomatsuri et al. | |
| 7,634,986 | B2 | 12/2009 | Kuroda et al. | |
| 2005/0081831 | A1* | 4/2005 | Larsson | 123/510 |
| 2006/0231080 | A1 | 10/2006 | Tomatsuri et al. | |
| 2007/0039865 | A1* | 2/2007 | Jiang et al. | 210/259 |
| 2007/0283929 | A1* | 12/2007 | Funabashi et al. | 123/446 |
| 2009/0007892 | A1 | 1/2009 | Burkitt | |

FOREIGN PATENT DOCUMENTS

| | | | |
|---|---|---|---|
| JP | 59-141159 | U | 9/1984 |
| JP | 2002-317721 | A | 10/2002 |
| JP | 2003-161219 | A | 6/2003 |
| JP | 2006-161716 | A | 6/2006 |
| JP | 2006-299824 | A | 11/2006 |
| JP | 2007-162624 | A | 6/2007 |
| JP | 2008-151077 | A | 7/2008 |
| JP | 2009-138597 | A | 6/2009 |
| JP | 2009-293541 | A | 12/2009 |
| JP | 2010-156261 | A | 7/2010 |
| JP | 2011-106329 | A | 6/2011 |
| KR | 10-2003-0068396 | A | 8/2003 |
| WO | WO-01-92714 | A2 | 12/2001 |

OTHER PUBLICATIONS

International Preliminary Report on Patentability (Chapter II) (in Korean) for PCT/KR2011/005142, dated Nov. 28, 2013; IPEA/KR.

Extended Search Report for European Patent Application No. 11869344.9 mailed Apr. 15, 2015 (6 pages).

State Intellectual Property Office (SIPO) of People's Republic of China Notification of the Second Office Action issued on Apr. 22, 2016 relating to corresponding China Application No. 201180072155.0 (with English translation). (12 pages).

* cited by examiner

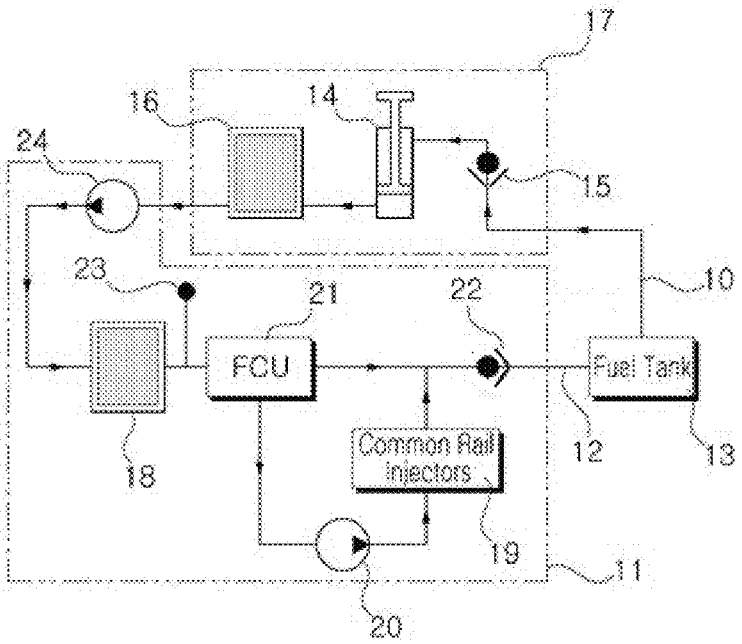
17
16
14
24
15
10
23
21
22
FCU
Fuel Tank
Common Rail
Injectors
12
13
18
19
11
20

FUEL SYSTEM FOR AN EXCAVATOR

FIELD OF THE INVENTION

The present invention relates to a fuel system for an excavator. More particularly, the present invention relates to a fuel system for an excavator, in which in the case where the equipment is suspended in operation so as to be left to stand idle by the start off of an engine, the remaining fuel remained after being combusted on the engine stays on a common rail injector side of the engine without being returned to a fuel tank so that the remaining fuel can be used during the start-up of the engine.

BACKGROUND OF THE INVENTION

In general, a common rail engine is an engine that stores fuel in a common rail as a high-pressure fuel storage device and injects the fuel into a combustion chamber of a cylinder at high pressure more than a predetermined pressure to burn the fuel. In this case, the common rail engine always maintains a constant pressure irrespective of an injection cycle and separately performs pressure maintenance and injection of the fuel. For this reason, the pressure and injection time of the fuel can be controlled depending on the operation condition of the engine so that the amount of an exhaust gas discharged from a diesel engine can be reduced, the ride comfortableness of the equipment such as an excavator can be improved, and fuel efficiency can be increased.

In case of the above-described common rail engine, in the case where the work is completed and the equipment is suspended in operation so as to be left to stand idle by the start off of the engine, the remaining fuel remained after being combusted on the engine is returned to a fuel tank along a return line by a pressure difference and a fuel supply circulation cycle. In this case, a phenomenon occurs in which a plunger and a barrel are not completely sealed externally, and in which the fuel leaks to a valve cover through such a portion and air in the valve cover flows in inversely. In addition, in the case where the fuel is not remained in the engine, the start-up performance of the engine is degraded, so that an error signal is indicated on an instrument board of an operator cab or the operation of the equipment becomes impossible.

For this reason, since an operator is required to manually manipulate a hand pump (referring to a prime pump operated manually) for start-up to supply fuel to the engine, and manipulate the hand pump, whenever necessary, he or she suffers from a great inconvenience.

In addition, since a pressure is significantly increased due to the excessive manipulation of the hand pump and the hand pump is used as occasion demands, internal leakage of fuel and damage of the hand pump may be caused. Besides, there may occur a problem in that the check valve installed between the fuel tank and the hand pump is damaged.

DETAILED DESCRIPTION OF THE INVENTION

Technical Problems

Accordingly, the present invention has been made to solve the aforementioned problem occurring in the prior art, and it is an object of the present invention to provide a fuel system for an excavator in which in the case where the equipment is not operated by the start-off of the engine, the remaining fuel that is remained after being used on the engine remains on the common rail injector side without being returned to the fuel tank so that the start-up performance of the engine can be improved.

Another object of the present invention is to provide a fuel system for an excavator in which the manipulation of the hand pump is not required to start up the engine, thereby improving convenience, and internal leakage of oil and damage of parts such as the hand pump, the check valve, and the like due to a rise of pressure according to an excessive manipulation of the hand pump can be prevented.

Technical Solution

To accomplish the above object, in accordance with an embodiment of the present invention, there is provided a fuel system for an excavator, including:

a fuel tank including a fuel supply line along which fuel is discharged therefrom and a return line along which the remaining fuel is returned thereto after being combusted on an engine;

a water separator including a hand pump installed on a downstream side of the fuel tank in such a manner as to be connected to the fuel supply line and configured to remove water contained in the intake fuel and, and a first filter connected to the hand pump and configured to filter foreign substances in the fuel;

an injection pump installed on a downstream side of the water separator and configured to supply the fuel, from which the foreign substances are filtered while passing through the first filter and a second filter connected to the first filter, to an injector at high pressure so as to inject the filtered fuel into an engine combustion chamber;

a fuel control unit connected to the second filter and the injection pump and configured to control the amount of fuel that is supplied to the injector through the control of the injection pump; and a check valve installed on the return line and configured to allow the remaining fuel that is remained after being used on the engine to remain on the injector side rather than being returned to the fuel tank along the return line in the case where the equipment is not operated by the start-off of the engine.

In accordance with an embodiment of the present invention, the fuel system may further include a pressure sensor installed in a pipe between the second filter and the fuel control unit and configured to detect the pressure of the fuel that has passed through the second filter and to output a detection signal for application to the fuel control unit.

Advantageous Effect

The fuel system for an excavator in accordance with an embodiment of the present invention as constructed above has the following advantages.

In the case where the equipment is not operated by the start-off of the engine, the remaining fuel that is remained after being used on the engine remains on the common rail injector side without being returned to the fuel tank so that the start-up performance of the engine can be improved.

In addition, since the manipulation of the hand pump is not required to start up the engine, internal leakage of oil and damage of parts such as the hand pump, and the like due to a rise of pressure according to an excessive manipulation of the hand pump can be prevented, thereby ensuring reliability and practicality.

BRIEF DESCRIPTION OF THE INVENTION

The above objects, other features and advantages of the present invention will become more apparent by describing the preferred embodiments thereof with reference to the accompanying drawings, in which:

FIG. 1 is a block diagram showing a configuration of a fuel system for an excavator in accordance with an embodiment of the present invention.

EXPLANATION ON REFERENCE NUMERALS OF MAIN ELEMENTS IN THE DRAWINGS

10: fuel supply line
11: engine
12: return line
13: fuel tank
14: hand pump
15: check valve
16: first filter
17: water separator
18: second filter
19: injector
20: injection pump
21: fuel control unit
22: check valve
23: pressure sensor
24: fuel supply pump

PREFERRED EMBODIMENTS OF THE INVENTION

Now, preferred embodiments of the present invention will be described in detail with reference to the accompanying drawings. The matters defined in the description, such as the detailed construction and elements, are nothing but specific details provided to assist those of ordinary skill in the art in a comprehensive understanding of the invention, and the present invention is not limited to the embodiments disclosed hereinafter.

A fuel system for an excavator in accordance with an embodiment of the present invention as shown in FIG. 1 includes:

a fuel tank 13 that includes a fuel supply line 10 along which fuel is discharged therefrom and a return line 12 along which the remaining fuel is returned thereto after being combusted in a combustion chamber of an engine 11;

a water separator 17 that includes a hand pump 14 for start-up of the engine, which is installed on a downstream side of the fuel tank 13 in such a manner as to be connected to the fuel supply line 10 and is configured to remove water contained in the intake fuel (referring to gas oil), a check valve which is installed on the fuel supply line 10, and a first filter 16 which is connected to the hand pump 14 and is configured to filter foreign substances or water in the fuel;

an injection pump 20 that is installed on a downstream side of the water separator 17 and is configured to supply the fuel (referring to gas oil), from which the foreign substances are filtered while sequentially passing through the first filter 16 and a second filter 18 connected to the first filter by the fuel supply pump 24, to common rail injector 19 at high pressure so as to inject the filtered fuel into the engine combustion chamber (not shown);

a fuel control unit (FCU) 21 that is connected to the second filter 18 and the injection pump 20 and is configured to control the amount of fuel that is supplied to the injector 19 through the control of the injection pump 20; and a check valve 22 that is installed on the return line 12 and is configured to allow the remaining fuel that is remained after being used on the engine 11 to remain on the injector 19 side rather than being returned to the fuel tank 13 along the return line 12 in the case where the equipment is not operated by the start-off of the engine, so that the remaining fuel can be used during the start-up of the engine.

Herein, the fuel system may further include a pressure sensor 23 that is installed in a pipe between the second filter 18 and the fuel control unit 21 and configured to detect the pressure of the fuel that has passed through the second filter 18 and to output a detection signal for application to the fuel control unit 21.

Hereinafter, a use example of the fuel system for an excavator in accordance with an embodiment of the present invention will be described in detail with reference to the accompanying drawings.

As shown in FIG. 1, fuel (referring to gas oil) discharged from the fuel tank 13 installed at one side of a combustion chamber of the engine of the excavator is supplied to the water separator 17 along the fuel supply line 10 and is filled in the water separator 17. In other words, the fuel supplied to the water separator 17 through the fuel supply line 10 sequentially passes through the check valve 15 and the first filter 16, which are installed on the fuel supply line 10, by the pumping operation of the hand pump 14, so that water or foreign substances contained in the fuel (gas oil) can be removed.

Then, the fuel from which water or the like is removed by the water separator 17 is supplied to the engine 11 by the pumping operation of the fuel supply pump 24. That is, the fuel passing through the fuel supply pump 24 passes through the second filter 15, and then is supplied to the common rail injector 19 at high pressure by the pumping operation of the injection pump 20 under the control of the fuel control unit 21. In this case, the pressure of the fuel passing through the second filter 15 is detected by the pressure sensor 23, which in turn outputs a detection signal for application to the fuel control unit 21. In other words, the injection pump 20 is controlled by a control signal from the fuel control unit 21 based on the detected pressure value of the fuel so that the amount of the fuel supplied to the injector 19 can be controlled.

Thus, the fuel is injected by a predetermined amount into the combustion chamber of the engine 11 through the nozzle of the injector 19 in response to a control signal from an ECU (not shown) so that the fuel is burned in the cylinder.

In this case, the fuel supplied to the engine 11 from the fuel tank 13 is sprayed into and combusted in the combustion chamber of the engine according to an engine state mode, and the remaining fuel remained after combustion is returned to the fuel tank 13 along the return line 12 to thereby form a fuel supply circulation cycle.

As one example, in the case where the work is completed and the equipment is suspended in operation so as to be left to stand idle by the start off of the engine 11, the remaining fuel remained after being combusted on the engine 11 stays on the injector 19 side of the engine by means of the check valve 22 installed on the return line 12, but is not returned to the fuel tank 13. On the contrary, conventionally, the remaining fuel remained on the engine is returned to the fuel tank along the return line. Thus, in order to start up the engine in a state in which the engine is suspended in operation for a predetermined time period, it is not until the hand pump constituting the water separator is operated that the fuel for start-up is supplied to the engine.

For this reason, in the case where the engine is started up in a state in which the engine is suspended in operation for a predetermined time period, the fuel needed to start up the engine 11 is secured even without operating the hand pump 14 for start-up so that the start-up performance of the engine can be improved. Moreover, since the manipulation of the hand pump 14 is not required to start up the engine 11, internal leakage of oil and damage of parts such as the hand pump 14, the check valve 15, and the like due to a rise of pressure according to an excessive manipulation of the hand pump can be prevented.

While the present invention has been described in connection with the specific embodiments illustrated in the drawings, they are merely illustrative, and the invention is not limited to these embodiments. It is to be understood that various equivalent modifications and variations of the embodiments can be made by a person having an ordinary skill in the art without departing from the spirit and scope of the present invention. Therefore, the true technical scope of the present invention should not be defined by the above-mentioned embodiments but should be defined by the appended claims and equivalents thereof.

INDUSTRIAL APPLICABILITY

As described above, according to the fuel system for an excavator in accordance with an embodiment of the present invention, in the case where the equipment is not operated by the start-off of the engine, the remaining fuel that is remained after being used on the engine remains on the common rail injector side without being returned to the fuel tank so that the start-up performance of the engine can be improved. In addition, since the manipulation of the hand pump is not required to start up the engine, internal leakage of oil and damage of parts such as the hand pump, and the like due to a rise of pressure according to an excessive manipulation of the hand pump can be prevented.

The invention claimed is:

1. A fuel system for an excavator comprising:

a fuel tank, a water separator, an engine, and fuel supply lines configured to conduct fuel from the fuel tank to the water separator, from the water separator to the engine, and from the engine back to the fuel tank;

a hand pump included with the water separator, the hand pump configured such that actuation of the hand pump removes water from the fuel;

a fuel supply pump included with the engine, the fuel supply pump configured to pump fuel from the fuel tank, through the water separator, and to the engine;

common rail fuel injectors included with the engine and configured to deliver fuel to combustion chambers of the engine;

an injection pump included with the engine and configured to pump fuel to the common rail fuel injectors;

a fuel control unit that is included with the engine and controls the injection pump, the fuel control unit is configured to: (A) direct fuel from the water separator back to the fuel tank without the fuel flowing to the common rail injectors; or (B) activate the injection pump to direct fuel from the water separator to the common rail fuel injectors and the combustion chambers, the fuel is combusted in the combustion chambers and any fuel remaining after combustion is directed back to the fuel tank;

a pressure sensor included with the engine and configured to input fuel pressure readings to the fuel control unit, the fuel control unit is configured to control fuel flow to the common rail fuel injectors based on the fuel pressure readings input to the fuel control unit;

a check valve included with the engine, the check valve is positioned along the fuel supply line exiting the engine to the fuel tank and is positioned to receive: (A) fuel that the fuel control unit directed to the common rail fuel injectors; and (B) fuel that the fuel control unit directed around the common rail fuel injectors;

wherein:

the check valve is configured to retain fuel within the engine upstream of the common rail injectors after the engine has been shut off, the retained fuel having been previously processed by the water separator to remove water therefrom; and upon restarting of the engine the retained fuel having water already removed therefrom is directed to the common rail injectors for combustion by the engine, thus making it unnecessary to actuate the hand pump at engine restart to remove water from fuel.

* * * * *